US009577344B2

(12) United States Patent
Stambovsky

(10) Patent No.: US 9,577,344 B2
(45) Date of Patent: Feb. 21, 2017

(54) ACTUATED PIN ANTENNA REFLECTOR

(71) Applicant: THE UNITED STATES OF AMERICA AS REPRESENTED BY THE SECRETARY OF THE AIR FORCE, Washington, DC (US)

(72) Inventor: Daniel W. Stambovsky, New Hartford, NY (US)

(73) Assignee: The United States of Americ as represented by the Secretary of the Air Force, Washington, DC (US)

( * ) Notice: Subject to any disclaimer, the term of this patent is extended or adjusted under 35 U.S.C. 154(b) by 493 days.

(21) Appl. No.: 14/167,269

(22) Filed: Jan. 29, 2014

(65) Prior Publication Data

US 2015/0145726 A1 May 28, 2015

Related U.S. Application Data

(60) Provisional application No. 61/909,454, filed on Nov. 27, 2013.

(51) Int. Cl.

| | |
|---|---|
| ***H01Q 15/20*** | (2006.01) |
| ***H01Q 15/14*** | (2006.01) |
| ***H01Q 1/12*** | (2006.01) |
| ***H01Q 3/01*** | (2006.01) |

(52) U.S. Cl.

CPC ..... *H01Q 15/147* (2013.01); *H01Q 1/1264* (2013.01); *H01Q 3/01* (2013.01)

(58) Field of Classification Search

CPC ..... H01Q 15/147; H01Q 1/1264; H01Q 3/01

USPC ..... 342/385; 343/915

See application file for complete search history.

(56) References Cited

U.S. PATENT DOCUMENTS

| | | | | |
|---|---|---|---|---|
| 5,440,320 | A * | 8/1995 | Lach | H01Q 15/147 343/912 |
| 5,592,174 | A * | 1/1997 | Nelson | G01S 19/22 342/357.64 |
| 5,976,287 | A * | 11/1999 | Parsons | G01B 7/14 156/245 |
| 6,100,855 | A * | 8/2000 | Vinson | H01Q 1/12 343/700 MS |
| 2003/0234970 | A1* | 12/2003 | Phillips | G02B 26/0825 359/291 |
| 2008/0231497 | A1* | 9/2008 | Sakamoto | G01S 7/35 342/70 |
| 2013/0076590 | A1* | 3/2013 | Baudasse | H01Q 3/01 343/915 |

(Continued)

*Primary Examiner* — Marcus Windrich

(74) *Attorney, Agent, or Firm* — Joseph A. Mangini

(57) ABSTRACT

Apparatus for improving the performance and allowing increased directionality of reflecting-type antenna systems by varying the geometry of the reflecting surface. A reflecting surface is composed of an array of actuated pins which are capable of extending or retracting to alter the overall pattern. An actuator controlling unit has the address of each actuator and is able to extend or retract the pins to the desired degree. The specific pattern which the actuator control unit realizes is determined by the iterative position calculator which utilizes directional inputs from the user and/or inputs from a system which determines the effectiveness of previous pin movements. The apparatus attempts to maximize the received signal by assessing amplitude changes over time and utilizing that information to direct alteration in the reflecting surface for optimal performance.

7 Claims, 5 Drawing Sheets

(56) References Cited

U.S. PATENT DOCUMENTS

| | | | | |
|---|---|---|---|---|
| 2013/0265209 | A1* | 10/2013 | Brossier | H01Q 1/288 343/915 |
| 2014/0266955 | A1* | 9/2014 | Yi | H01Q 15/147 343/837 |
| 2015/0070216 | A1* | 3/2015 | Alexopoulos | H01Q 3/247 342/368 |

* cited by examiner

ACTUATED PIN ANTENNA REFLECTOR

PRIORITY CLAIM UNDER 35 U.S.C. §119(e)

This patent application claims the priority benefit of the filing date of provisional application Ser. No. 61/909,454, having been filed in the United States Patent and Trademark Office on Nov. 27, 2013 and now incorporated by reference herein.

STATEMENT OF GOVERNMENT INTEREST

The invention described herein may be manufactured and used by or for the Government for governmental purposes without the payment of any royalty thereon.

BACKGROUND OF THE INVENTION

This invention relates generally to reflector-type antennas, and, more specifically, to software definable antennas capable of functioning across a wide range of frequency ranges and environmental conditions. This invention also relates to the testing, design, and fabrication of antenna reflectors.

That there is a clearly stated need for a software defined antenna system to pair with the growth in software based radios is well known across both government and industry. In order to gain the full benefit of these novel radios, flexible antenna hardware is urgently needed.

It is clearly desirable to provide geometrically flexible antenna hardware capable of functioning efficiently across a broad range of frequencies, signal types, and environmental conditions.

An optimal solution to the problem of building hardware functional across a wide bandwidth, with variable power transmit and receive, capable of functioning in degraded or cluttered environments, is a maximally adaptive radio system. The prior art has embarked upon a quest to engineer this very approach but while it has succeeded in building software defined (thus highly adaptive) radios, it has failed to generate an antenna system which would allow it to function to its full potential. Specifically, the prior art still utilizes standard hardware such as patch antennas, and therefore still unable to gain full usage from these novel software defined radio systems. Additionally, the majority of the explorations into the field of reconfigurable antennas have been at the lower end of the size and power scale, with minimal efforts into larger, higher power applications.

U.S. Patent Application Publication No. US20130265209 A1 to Brossier et al. discloses a Ku-band reconfigurable reflector-type antenna composed of a reflecting membrane connected to a rigid support via a series of actuators which deform the membrane to allow a variety of reflecting geometries. This system, however, is designed for low weight applications (notably spacecraft) and lacks the degree of versatility that software defined radios would necessarily require.

OBJECTS AND SUMMARY OF THE INVENTION

It is therefore an object of the present invention to provide an apparatus that overcomes the prior art's dependency on fixed, non-reconfigurable reflector antennas.

It is a further object of the present invention to overcome the limitations of manually reconfigurable antenna reflectors which cannot perform precise, on-the-fly geometrical alterations to the reflector.

It is yet a further object of the present invention to provide the capability of increasing the signal to noise ratio of received signals in dynamically changing interference environments by adapting the reflector shape in real time to maximize the amplitude of the received signal.

It is yet still a further object of the present invention to provide an apparatus with the capability of physically modeling a wide range of possible reflector shapes for the purposes of testing and prototyping.

Briefly stated, the present invention is an apparatus for improving the performance and allowing increased directionality of reflecting-type antenna systems by varying the geometry of the reflecting surface. A reflecting surface is composed of an array of actuated pins which are capable of extending or retracting to alter the overall pattern. An actuator controlling unit has the address of each actuator and is able to extend or retract the pins to the desired degree. The specific pattern which the actuator control unit realizes is determined by the iterative position calculator which utilizes directional inputs from the user and/or inputs from a system which determines the effectiveness of previous pin movements. The apparatus attempts to maximize the received signal by assessing amplitude changes over time and utilizing that information to direct alteration in the reflecting surface for optimal performance.

According to a preferred embodiment of the present invention, a variable geometry reflecting antenna apparatus, comprises a backplane; a plurality of pins each having a head and a shaft, where each shaft protrudes through the backplane at a substantially perpendicular orientation to the backplane; an actuator connected to each shaft, where the actuator displaces the shaft in a linear manner so as to vary the distance between the head and the backplane; and a control system for controlling the actuators.

According to an alternate embodiment of the present invention, a variable geometry reflecting antenna apparatus, comprising a backplane; a plurality of pins each having a head and a shaft, where each shaft protrudes through the backplane at a substantially perpendicular orientation to the backplane; a contact surface incorporated into each shaft; a plurality of signal feeds incorporated into the backplane, where each signal feed corresponds to each contact surface; an actuator connected to each shaft, where the actuator displaces shaft in a linear manner so as to vary the distance between the head and the backplane; an impedance matching network for matching the impedance of a signal path from the pins, the contact surfaces and the signal feeds to a transmit and receive signal source; and a control system for controlling the actuators.

Referring to FIG. 2, the present invention called an Actuated Pin Antenna Reflector (APAR) is composed of an array of broad-headed pins 100 set into and extending behind an anechoic backplane 110. There are multiple possible means of performing the necessary processing to determine pin positions and to physically mobilize the pins, the most effective means envisioned would be the following described system.

The back of each pin 100 is attached to a mechanical actuator 120 capable of extending or retracting the pin 100 upon a command signal from the Actuator Control Unit (ACU) (see FIG. 1, 130) to which all actuators 120 are wired. The geometry of the pin head, length of the pin, number of pins, and distance of possible pin retraction would depend on the specific application of the present invention. The ACU (see FIG. 1, 130) stores pin addresses and generates control signals from inputs from the Iterative Position Calculator (IPC) 140 which utilizes a numeric approximation technique such as the Monte Carlo or a genetic algorithm method to determine the next set of pin positions. The IPC 140 receives information from the Reflector Control I/O (RCIO) 150 based on received signal strength comparisons from various iterations of pin 100 positions. Received signals are blocked into comparison bins (the precise timing of which would depend on the present invention's application) and sent both to the Digital Radio Frequency Memory (DRFM) (not part of invention and not shown) and to Amplitude Comparator Module (ACM) 210 where the nth bin is compared with the (n−1)th bin. This comparison is used to determine if the latest pin motion has improved the received amplitude.

The present invention or APAR, while capable of an extremely wide range of antenna geometries and on-the-fly signal, maximization might be unsuited for some highly mobile applications where weight is a major factor. It would be most apt for fixed applications requiring detection and amplification of low amplitude signals such as satellite communications, over the horizon radar, and radio astronomy. The dynamic capabilities of the present invention would enhance mitigation of atmospheric signal distortions as well as some measure of angular target detection. Additionally the present invention can be used in design of standard antenna reflectors where the precise geometry of the reflector is determined for a given application and then the pin 100 positions can be read from the ACU (see FIG. 1, 130) and fed into a 3-D printer for fabrication.

There are alternate means of implementing the actuated pin system into Radio Frequency (RF) transmit and receive systems. Referring to FIG. 3 and FIG. 4 depicts such an alternate embodiment of the present invention. In this alternate embodiment, the pins 100 have a contact surface 230 which, when the actuator 120 pushes the pin into the extended position, makes a short with the signal feed 220. This in turn allows the broad head of the pin 100 to radiate into free space so that the sum of the pins 100 actuated forward make up the radiating element of the antenna. In order to both transmit and receive in the most efficient possible manner, a software definable Impedance Matching Network receives inputs from the ACU 130 to compare with a predefined list of impedances for the number of pins 100 connected to the signal feeds at any given time. This system then ensures that the antenna system is impedance matched to the Receive/Transmit (Rx/Tx, see FIG. 2, 180) system at all times.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
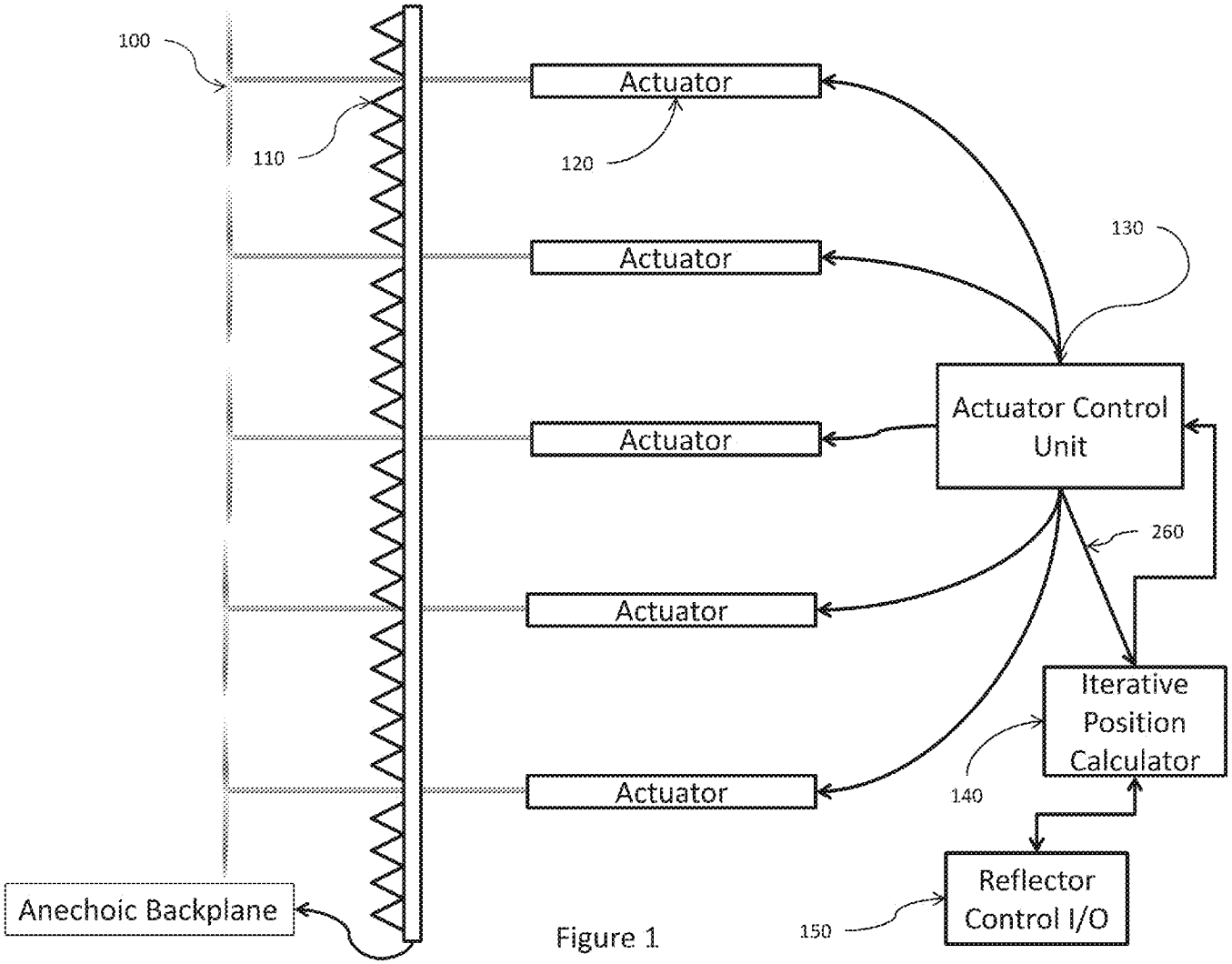
FIG. 1 is a schematic diagram representation of the preferred embodiment of the present invention pin actuation system.
Figure 2:
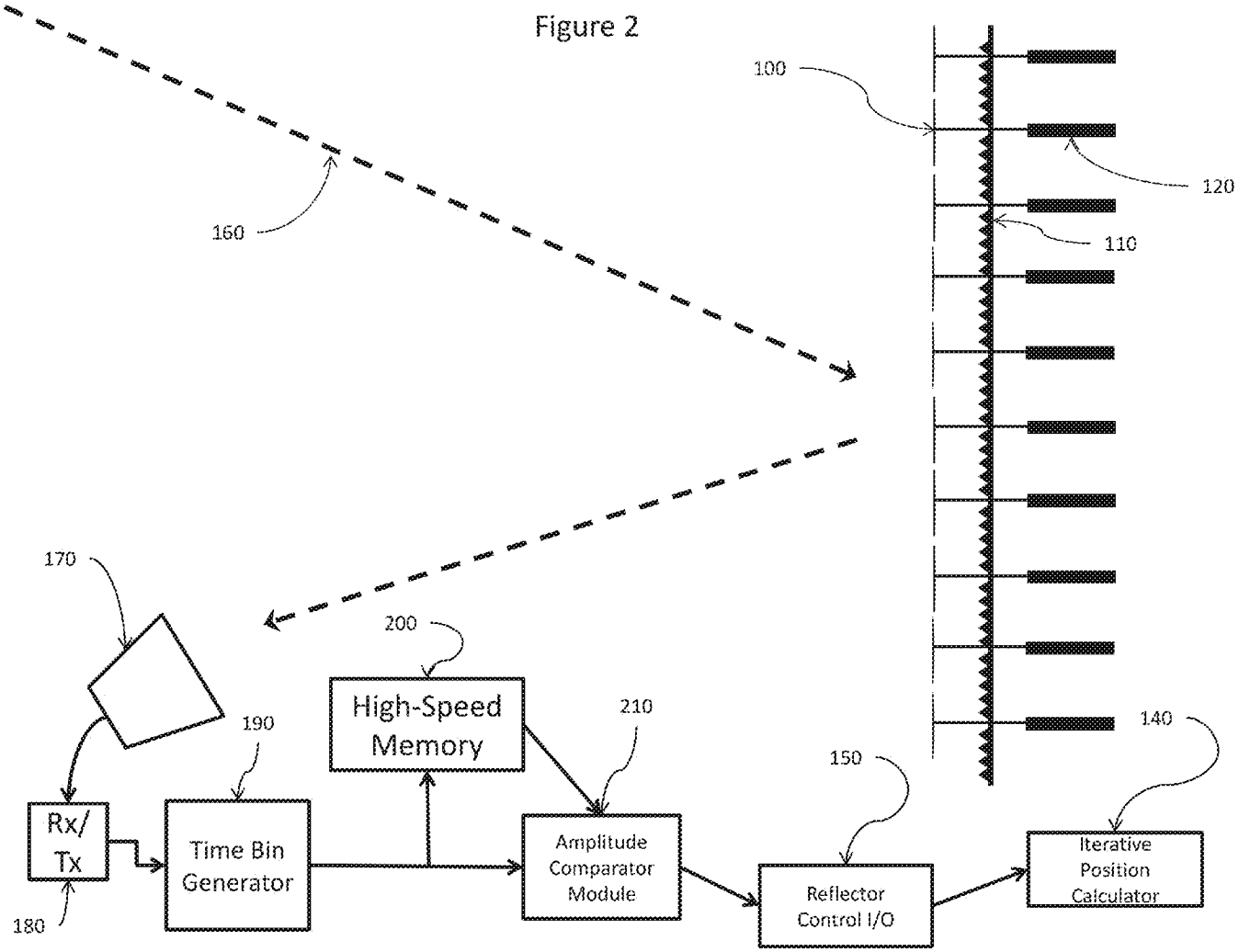
FIG. 2 is a schematic diagram representation of the preferred embodiment of the present invention reflecting transmit and receive system.
Figure 3:
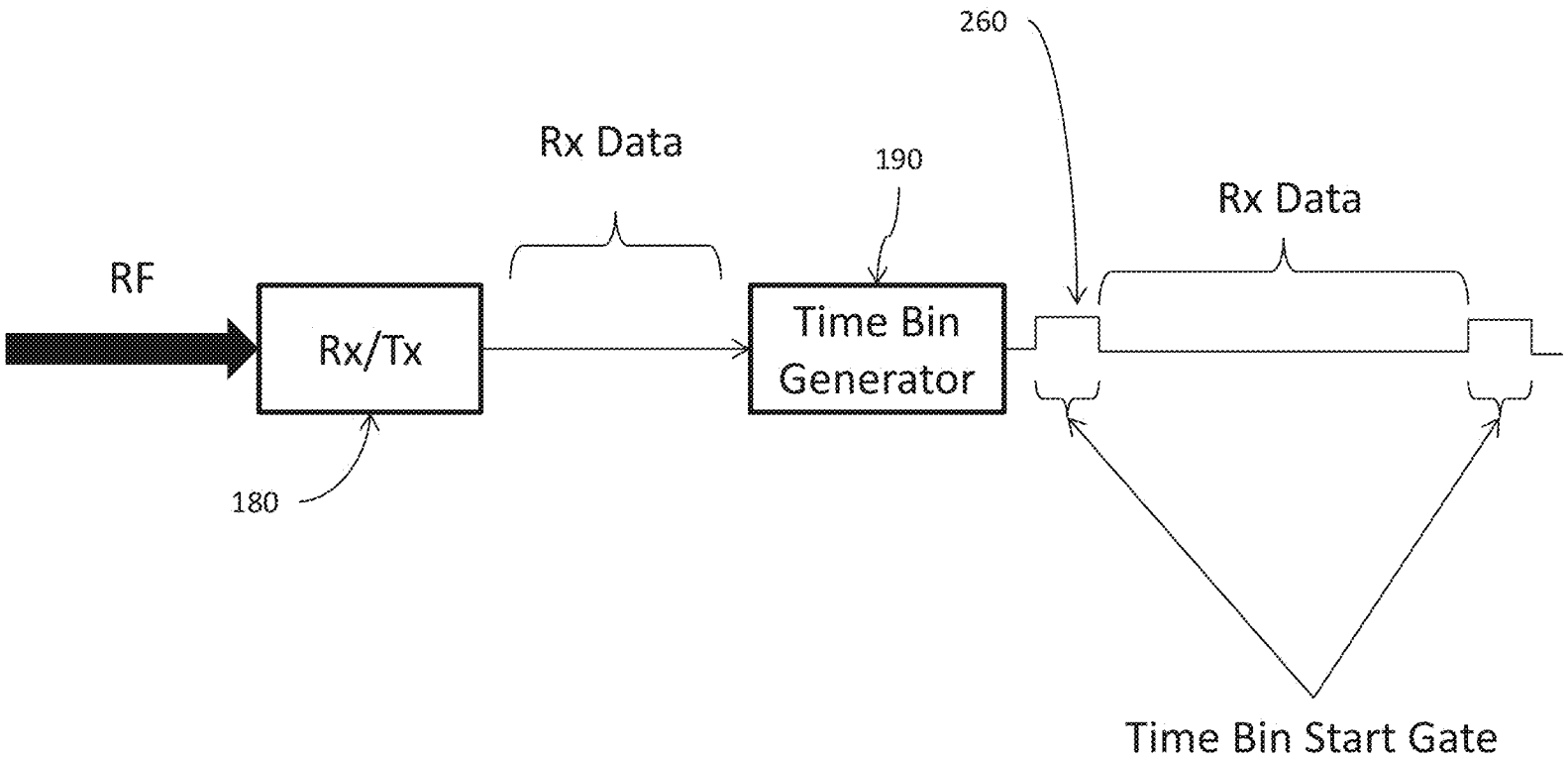
FIG. 3 depicts the received signal from the radio's Rx/Tx interface to the present invention's Time Bin Generator.

Referring now to FIG. 1, FIG. 2, and FIG. 3 describes the preferred embodiment of the present invention.

FIG. 1 shows a detail of the overall system illustrating the main novel points of the present invention. The broad head pins 100 make up the reflecting surface and it is the adjustment of the position of these pins which yields alterable overall geometry of the reflector. Behind the array of pins is an anechoic backplane 110 which helps isolate the reflecting surface and reduce any unwanted secondary reflections. Behind the backplane the pins are each attached to a precise, electrically controlled linear actuator 120 which serves as the motivator for the individual pins. In order to control the whole array of actuators the Actuator Control Unit (ACU) 130 contains the addressing and interface for each actuator, and is able to send the correct control signal to the correct actuator for any given position set. It also time-stamps the start and stop for pin movement time, and sends this Time Stamp Data created by Time Bin Start Gates 260 to the Iterative Position Calculator 140. The position set the ACU 130 will realize at any one point in time is determined by the Iterative Position Calculator 140 which takes inputs from the RF components of the system through the Reflector Control I/O 150 (see FIG. 2). The IPC 140 first uses ACU 130 and Amplitude Comparator Module 210 time stamp data to calculate if change in received signal amplitude is due to pin 100 position or inherent signal alterations. It then uses genetic algorithms to determine what the next reflector geometry should be based on the difference in system receive quality from the prior alteration of the reflector configuration, a difference calculated from signals sent by the Amplitude Comparator Module 210 and the time stamp information from the ACU 130. The IPC 140 is also able to accept directional control inputs from the system user which allows the system to alter the geometry of the reflector to receive or transmit in a specific direction. The Reflector Control I/O 150 converts the Amplitude Comparator Module 210 information into the proper format for the IPC 140 and transfers the data.

FIG. 2 shows how the radio frequency (RF) components of the preferred embodiment fits into the previously described section. The incoming RF signal 160 to be received strikes the reflecting surface formed by the array of pins 100 and is reflected into the receive feed-horn 170. The feed-horn and Receive/Transmit (Rx/Tx) interface 180 can be built around any of a number of prior art systems.

Referring to FIG. 3, the received signal from the radio's Rx/Tx interface 180 to the present invention is then input to the Time Bin Generator 190 where the data is split into time bins separated by Time Bin Start Gates 260. Referring back to FIG. 2, the received data is now separated into quantized segments as seen as the output of the Time Bin Generator 190. This formatted data, now isolated into segments by time bins, is sent to two places: the High-Speed Memory 200 and the Amplitude Comparator Module (ACM) 210. The High-Speed Memory 200 delays the received signal one timing bin and sends it on to the ACM 210 where it is compared to the next bin (i.e. the $n^{th}$ bin from the memory is compared with the $n+1^{th}$ bin from the Time Bin Generator 190 at the same time that the $n+1^{th}$ bin is saved to compare with the n+2 bin). The ACM 210 compares the relative amplitude of the receive signals in the different Time Bins to give an amplitude difference, it then time stamps this data for later comparison with pin motion position time gained from the Actuator Control Unit (see FIG. 1, 130), and sends it on to the Reflector Control I/O 150.

DETAILED DESCRIPTION OF AN ALTERNATE EMBODIMENT

Figure 4:
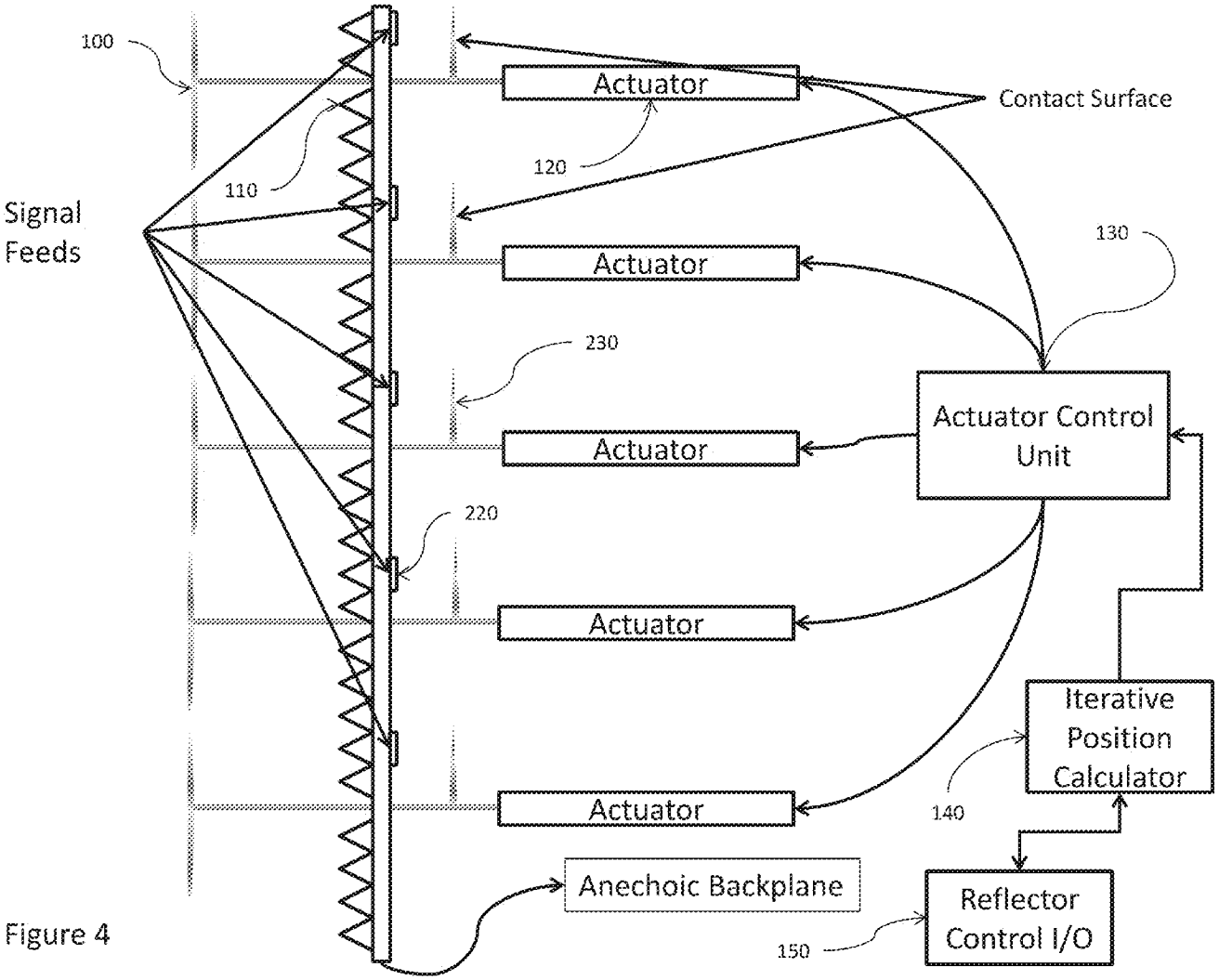
FIG. 4 is a schematic diagram of the alternate embodiment of the present invention showing the signal feed system as well as the Impedance Matching Network.
Figure 5:
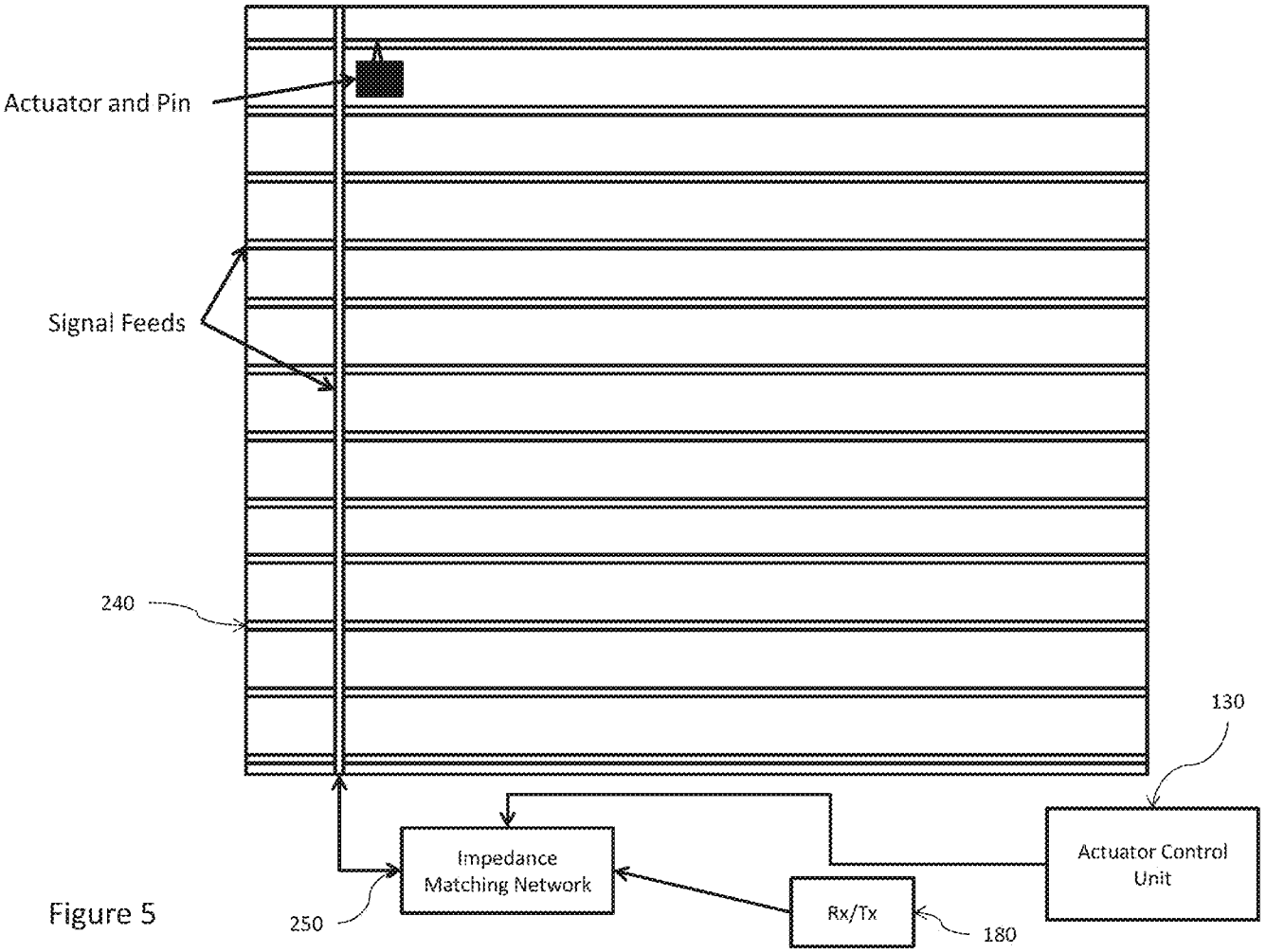
FIG. 5 is an image of the initial, manually operated test unit of the present invention.

Referring to FIG. 4, and FIG. 5 simultaneously, depicts an alternate embodiment of the present invention and its test article implementation, respectively, whereby the feedhorn 170 (see FIG. 1) and reflector system of RF transmission and reception are replaced through use of the pins 100 themselves. In this embodiment the actuated pins 100 have Contact Surfaces 230 which, when the pins 100 are actuated forward, make contact with Signal Feeds 220 that make up a Signal Feed Network 240. This network connects to the Rx/Tx interface 180 via an Impedance Matching Network 250, allowing the individual broad head elements of the pins 100 to act as radiating elements. When the Actuators 120 pull the pins 100 and their attached Contact Surfaces 230 away from the Signal Feeds 220, it breaks the contact and ensures the pin 100 in question will not radiate. In this way the Actuator Control Unit 130, working with the Impedance Matching Network 250 to reduce impedance mismatch, ensure that the proper set of pins 100 are part of the radiating element so that the overall geometry of the element is tuned as desired.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A variable geometry reflecting antenna apparatus, comprising:
- an anechoic backplane;
- a plurality of pins each having a head and a shaft, said shaft protruding through said anechoic backplane at a substantially perpendicular orientation to said anechoic backplane;
- an actuator connected to each said shaft, wherein said actuator displaces said shaft in a linear manner so as to vary the distance between said head and said anechoic backplane;
- a control system for controlling said actuators further comprising
  - an actuator control unit;
  - an iterative position calculator;
  - a time bin generator;
  - a high speed memory; and
  - an amplitude comparator module; wherein
    - said time bin generator quantizes and splits data corresponding to said received signal into time bins;
    - said high speed memory delays said quantized data from said time bin generator by one timing bin; and
    - said amplitude comparator module
      - compares the amplitude of said delayed quantized data from said high speed memory to the amplitude of a subsequent quantized data from said time bin generator;
      - computes an amplitude difference;
      - time stamps said amplitude difference; and
      - communicates said time stamped amplitude difference with said reflector control;
  - a reflector control; wherein
    - said reflector control compares previous pin positions to
      - measurements of a received signal corresponding thereto; and
      - current directivity commands:
    - said iterative position calculator determines subsequent pin positions by performing numeric approximation on said pin position and signal strength received from said reflector control; and
    - said actuator control unit commands said actuators in response to said pin positions received from said iterative position calculator.

2. The apparatus of claim 1, wherein said time-stamped amplitude difference is compared with pin position versus time data.

3. A variable geometry reflecting antenna apparatus, comprising:
- an anechoic backplane;
- a plurality of pins each having a head and a shaft, said shaft protruding through said anechoic backplane at a substantially perpendicular orientation to said anechoic backplane;
- a contact surface incorporated into each said shaft;
- a plurality of signal feeds incorporated into said anechoic backplane, each said signal feed corresponding to each said contact surface;
- an actuator connected to each said shaft, wherein said actuator displaces said shaft in a linear manner so as to vary the distance between said head and said anechoic backplane;
- an impedance matching network for matching the impedance of a signal path from said pins, said contact surfaces and said signal feeds to a transmit and receive signal source; and
- a control system for controlling said actuators;

wherein said actuator displacement of said shaft establishes and disestablishes radio frequency signal contact between said contact surface and said signal feed.

4. The apparatus of claim 3, wherein said control system further comprises;
- an actuator control unit;
- an iterative position calculator; and
- a reflector control; wherein
  - said reflector control compares previous pin positions to
    - measurements of a received signal corresponding thereto; and
    - current directivity commands;
  - said iterative position calculator determines subsequent pin positions by performing numeric approximation on said pin position and signal strength received from said reflector control; and
  - said actuator control unit commands said actuators in response to said pin positions received from said iterative position calculator.

5. The apparatus of claim 3, wherein said control system further comprises;
- a time bin generator;
- a high speed memory; and
- an amplitude comparator module; wherein
  - said time bin generator quantizes and splits data corresponding to said received signal into time bins;
  - said high speed memory delays said quantized data from said time bin generator by one timing bin; and said amplitude comparator module compares the amplitude of said delayed quantized data from said high speed memory to the amplitude of a subsequent quantized data from said time bin generator;

computes an amplitude difference, time stamps said amplitude difference; and communicates said time stamped amplitude difference with said reflector control.

6. The apparatus of claim 4, wherein a time-stamped amplitude difference is compared with pin position versus time data.

7. The apparatus of claim 3, wherein said iterative position calculator accepts directional control inputs directly so as to alter the position of said plurality of pins.

* * * * *